US011180820B1

(12) United States Patent
Huang et al.

(10) Patent No.: US 11,180,820 B1
(45) Date of Patent: Nov. 23, 2021

(54) HOT-WORK DIE STEEL AND A PREPARATION METHOD THEREOF

(71) Applicant: University of Science and Technology Beijing, Beijing (CN)

(72) Inventors: Jinfeng Huang, Beijing (CN); Jin Zhang, Beijing (CN); Cheng Zhang, Beijing (CN); Chao Zhao, Beijing (CN); Yong Lian, Beijing (CN); Jianqiang Li, Beijing (CN); Cheng Zhang, Luoyang (CN)

(73) Assignee: University of Science and Technology Beijing, Beijing (CN)

( * ) Notice: Subject to any disclaimer, the term of this patent is extended or adjusted under 35 U.S.C. 154(b) by 45 days.

(21) Appl. No.: 17/021,404

(22) Filed: Sep. 15, 2020

Related U.S. Application Data

(63) Continuation of application No. PCT/CN2020/091225, filed on May 20, 2020.

(51) Int. Cl.

| | |
|---|---|
| ***C22C 38/44*** | (2006.01) |
| ***C22C 38/46*** | (2006.01) |
| ***C22C 38/48*** | (2006.01) |
| ***B22C 9/06*** | (2006.01) |
| ***C21D 9/00*** | (2006.01) |

(Continued)

(52) U.S. Cl.

CPC ..... *C21D 9/0068* (2013.01); *B21D 37/10* (2013.01); *B22C 9/061* (2013.01); *C21D 1/28* (2013.01); *C21D 6/004* (2013.01); *C21D 6/005* (2013.01); *C21D 6/008* (2013.01); *C21D 8/005* (2013.01); *C22C 1/02* (2013.01); *C22C 38/002* (2013.01); *C22C 38/02* (2013.01); *C22C 38/04* (2013.01); *C22C 38/44* (2013.01); *C22C 38/46* (2013.01);

(Continued)

(58) Field of Classification Search
None
See application file for complete search history.

(56) References Cited

FOREIGN PATENT DOCUMENTS

| | | | |
|---|---|---|---|
| CN | 101392353 A | | 3/2009 |
| CN | 109487166 A | * | 3/2019 |

(Continued)

OTHER PUBLICATIONS

International Search Report for Application No. PCT/CN2020/091225 dated Jan. 22, 2021; 5 pgs.

*Primary Examiner* — Nicholas A Wang
*Assistant Examiner* — Anthony M Liang
(74) *Attorney, Agent, or Firm* — Umberg Zipser LLP

(57) ABSTRACT

The present application provides a hot-work die steel and a preparation method thereof wherein the chemical constituents of the hot-work die steel in mass percentage are as follows: C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, wherein an alloying degree is 5-7%; a tensile strength of the hot-work die steel at 700° C. is 560-700 MPa; a value of hardness of the hot-work die steel at room temperature is 32-38 HRC after holding at 700° C. for 3-5 h; and the hot-work die steel has an elongation of 14% to 16% at room temperature, a percentage reduction of area of 48% to 65%, and an impact toughness of 52-63 J at room temperature. The hot-work die steel of the present application has an excellent thermal stability as well as a good plasticity and a toughness at room temperature.

11 Claims, 5 Drawing Sheets

(51) Int. Cl.

| | |
|---|---|
| ***B21D 37/10*** | (2006.01) |
| ***C21D 6/00*** | (2006.01) |
| ***C21D 1/28*** | (2006.01) |
| ***C22C 1/02*** | (2006.01) |
| ***C22C 38/54*** | (2006.01) |
| ***C22C 38/52*** | (2006.01) |
| ***C22C 38/50*** | (2006.01) |
| ***C22C 38/04*** | (2006.01) |
| ***C22C 38/02*** | (2006.01) |
| ***C22C 38/00*** | (2006.01) |
| ***C21D 8/00*** | (2006.01) |

(52) U.S. Cl.
CPC ..... *C22C 38/48* (2013.01); *C22C 38/50* (2013.01); *C22C 38/52* (2013.01); *C22C 38/54* (2013.01)

(56) References Cited

FOREIGN PATENT DOCUMENTS

| | | | |
|---|---|---|---|
| CN | 109487166 | A | 3/2019 |
| CN | 110438310 | A | 11/2019 |
| KR | 101007417 | B1 | 1/2011 |

* cited by examiner

HOT-WORK DIE STEEL AND A PREPARATION METHOD THEREOF

FIELD OF THE INVENTION

This application relates to the field of hot-work die steel, in particular to a hot-work die steel and a preparation method thereof.

BACKGROUND OF THE INVENTION

Hot-work die steel is a die mainly used for pressing a solid or liquid metal above the recrystallization temperature into a workpiece, such as hot forging die, hot extruding die, die casting mold, etc. The working conditions of hot-work die steel are harsh. The mold cavity thereof is in direct contact with workpieces under high temperature, in which the local temperature can reach 600-700° C. At the meantime, the workpieces also suffer from various effects such as heavy loads at high temperature, high temperature strain fatigue, and cold-hot fatigue. Insufficient strength at high temperature can cause softening, deformation, and collapse of the die, and insufficient performances of thermal strain fatigue resistance and cold-hot fatigue will lead to the cracking and spalling of die. Therefore, the core and key indicators to improve the life of the hot-work die steel are the overall enhanced performances of the strength at high temperature, high temperature fatigue, cold-hot fatigue and other properties of the hot-work die steel.

The available hot-work die steel widely used is the medium alloy chromium type H13 steel (4Cr5MoSiV1). H13 steel has a good strength-toughness coordination and a thermal fatigue resistance below 550° C. However, the strength and the thermal stability of H13 steel decline sharply above 600° C. The tensile strength at 700° C. is only 260-320 MPa. The decrease in strength at high temperature also leads to a deterioration of its thermal fatigue resistance, and an increase in the tendency to hot crack at high temperature, which is impossible to satisfy the requirements for the working conditions of the hot-work die steel at high temperature.

In order to improve the operating temperature and the strength at high temperature of the hot-work die steel, it is common to increase the contents of carbon and alloy to produce hot-work die steel, for example the high alloy tungsten molybdenum type hot-work die steel (3Cr2W8V). The alloy content can be raised to above 10%, and the strength at a high temperature of 700° C. can be raised to 300-400 MPa. However, its toughness at room temperature is only 11-13 J, and the cold-hot fatigue resistance is poor, so that early failure often occurs due to cracking of the die. In view of the use safety, or the cost of processing, its application range is limited.

Therefore, a hot-work die steel with sufficient strength at high temperature, and good performances of plasticity, toughness and fatigue resistance at room temperature is desired.

SUMMARY OF THE INVENTION

The present application aims at providing a hot-work die steel and a preparation method thereof, so that the hot-work die steel has satisfactory plasticity and toughness, and stability during operation under high temperature. The specific technical solutions are as follows.

The first aspect of the present application is to provide a hot-work die steel, comprising the following chemical constituents: C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, and an alloying degree is 5-7%;

wherein a tensile strength of the hot-work die steel at 700° C. is 560-700 MPa;

wherein a value of hardness of the hot-work die steel at room temperature is 32-38 HRC after maintaining at 700° C. for 3-5 h; and wherein the hot-work die steel has an elongation of 14% to 16% at room temperature, a percentage reduction of area of 48% to 65%, and an impact toughness of 52-63 J at room temperature.

In an embodiment of the present application, the hot-work die steel further comprises at least one of the following chemical constituents:

Zr: 0.01-0.03 wt %, Co: 0.10-0.50 wt %, B: 0.001-0.005 wt %, Re: 0.01-0.10 wt % Ti: 0.02-0.06 wt %, and Y: 0.01-0.1 wt %.

In an embodiment of the present application, the hot-work die steel comprises less than 0.02 wt % of S and less than 0.02 wt % of P.

In an embodiment of the present application, the tempered sorbite structure still retains the lath characteristic after the hot-work die steel is stretched at 700° C.

In an embodiment of the present application, the carbide in the hot-work die steel is a nanoscale acicular MC type alloy carbide after the hot-work die steel is stretched at 700° C.

In an embodiment of the present application, the nanoscale acicular MC type alloy carbide is: $V_{0.5\text{-}0.8}Mo_{0.5\text{-}0.6}Cr_{0.15\text{-}0.3}W_{0.06\text{-}0.14}Nb_{0.01\text{-}0.02}C$.

In an embodiment of the present application, the tensile strength of the hot-work die steel at 700° C. is 600-700 MPa.

The second aspect of the present application is to provide a method for producing the hot-work die steel according to any one of the above aspects, comprising:

a smelting step: preparing a raw material according to the following mass percentages:

C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, processing the raw material into an electrode rod by arc melting, secondary refining, vacuum degassing, and forging in a forging furnace;

an electroslag remelting step: removing an oxidized layer of the electrode rod, then introducing the electrode rod into a vacuum electroslag remelting device for secondary refining, keeping a temperature of water in the water cooling system of the electroslag remelting device not higher than 70° C., and obtaining an electroslag ingot by electroslag remelting from the electrode rod, wherein the melting rate is 7-12 kg/min, and the temperature of a cooling water of a crystallizer is held at 40-50° C.;

a homogenizing annealing step: heating the electroslag ingot to 1200-1250° C. and holding for 15-23 h;

a forging step: cooling the electroslag ingot to a forging heating temperature of 1150-1200° C. and then forging to obtain an ingot, wherein the initial forging temperature is 1130 to 1160° C., and the final forging temperature is ≥850° C.;

an annealing after forging step: introducing the ingot into an annealing furnace after the temperature of the ingot is lower than 500° C., heating to 830-890° C. at a heating rate of not more than 100° C./h, holding for [120 min+r (mm)×2 min/mm] or [120 min+d (mm)/2×2 min/mm], lowering the temperature to below 500° C. at a cooling rate of 20-40° C./h, taking the ingot out from annealing furnace, and air-cooling to obtain an annealed ingot;

a heat treatment of fine grain step: heating the annealed ingot to 930-1150° C. and performing a first holding for a first holding time of [(15-40) min+r (mm)×2 min/mm] or [(15-40) min+d (mm)/2×2 min/mm], water cooling to 400-500° C. within 1-2 min, then air cooling to 250-280° C. and performing a second holding for a second holding time of 5-10 h; and then holding at a temperature of 660-700° C. for 5-10 h;

a tempering treatment step: heating the held ingot to 980-1100° C. and holding for [(15-40) min+r (mm)×2 min/mm] or [(15-40) min+d (mm)/2×2 min/mm], then cooling to 50-150° C., and then tempering at 580-660° C. and holding for 6-16 h to obtain the hot-work die steel;

wherein r is a radius of the material and d is a thickness of the material.

In an embodiment of the present application, the raw material further comprises at least one of the following constituents: Zr: 0.01-0.03 wt %, Co: 0.10-0.50 wt %, B: 0.001-0.005 wt %, Re: 0.01-0.10 wt %, Ti: 0.02-0.06 wt %, and Y: 0.01-0.1 wt %.

In an embodiment of the present application, the forging step specifically includes: forming and forging by means of a precision forging machine, wherein the forging heating temperature is 900-1050° C., the initial forging temperature is 850-950° C., and the final forging temperature is ≥800° C.;

alternatively, forming and forging by a hydraulic hammer or oil hydraulic press, wherein the forging heating temperature is 1150-1200° C., the initial forging temperature is 1130-1160° C., and the final forging temperature is ≥850° C.

In an embodiment of the present application, the holding time of the annealing after forging step is 6-8 h.

In the present application, the term "alloying degree" refers to the total content of other elements in addition to iron and carbon in the steel.

The present application provides a hot-work die steel with a tensile strength of 560-700 MPa at 700° C., which is twice more than H13 steel, and about 1.5 times more than 3Cr2W8V. The operating temperature is increased from 600° C. (for available H13 steel) to 700° C., and the increase range is up to 100° C. Therefore, the stability of the hot-work die steel is enhanced during operation at much higher temperature, compared with conventional hot-work die steel. In addition, the hot-work die steel of the present application has good plasticity and toughness at room temperature as well as fatigue resistance at high temperature, thus expanding the application range of the hot-work die steel.

The present application provides a heat treatment process for the hot-work die steel, wherein the hot-work die steel is allowed to have a tensile strength of 560-700 MPa at 700° C. and a value of hardness of 32-38 HRC at room temperature after holding for 3-5 h at 700° C. by controlling the addition proportions of each raw material and reasonable forging and heat treatment process. Moreover, the hot-work die steel of the present application has good plasticity and toughness at room temperature, which is superior than that of the available H13 steel, and is equivalent to low-carbon and low-alloy hot-work die steel. It also has good high temperature strain fatigue resistance, thus expanding the application range of the hot-work die steel.

Indeed, it is not necessary to achieve all of the above benefits at the same time when implementing any one of product or method of the present application.

DESCRIPTION OF THE DRAWINGS

In order to further explicitly explain the technical solutions in the present application and in the art, accompany figures regarding the examples and the prior art are briefly introduced as follows. These figures are only some examples of the present application and it is obvious for those skilled in the art to obtain other technical solutions based on these figures without inventive efforts.

DETAILED DESCRIPTION OF THE INVENTION

Figure 1:
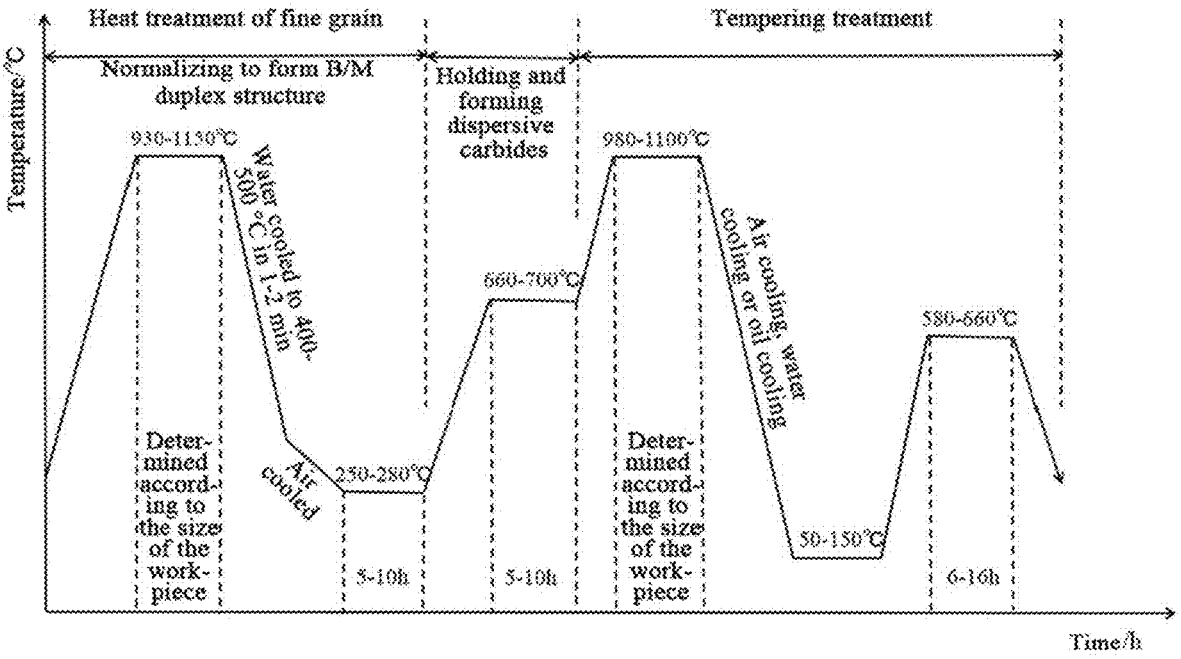
FIG. 1 is a process chart of the heat treatment process for the hot-work die steel of the present application.

The object, technical solution and advantages of the invention will be described in detail below with reference to the accompany figures and the examples in order to further illustrate the present application. It is apparent that the described examples are only a part of the examples of the present application, not all of them. All of the examples obtained based on the examples of the invention without inventive effort made by those skilled in the art are within the protection scope of the present application.

In the prior art, H13 steel is improved by raising the content of carbon and alloy to promote the formation of carbide with high melting point to enhance the high temperature strength by solution strengthening and dispersion strengthening of the carbide, so that the low temperature toughness and the high temperature strength at room temperature of this hot-work die steel are enhanced. Although this process has certain enhancing effect on the high temperature strength of the steel at about 600° C., the enhancing effect on the steel at higher temperatures, such as at 700° C., is limited. This is mainly because the coherent relationship between $M_2C$ or MC carbide and matrix is damaged when the temperature exceeds 600° C., and the carbide transforms into incoherent $M_6C$ or $M_{23}C_6$ carbide which is easy to grow up and will lead to a significantly weakened strengthen effect. Therefore, the existing design principles and methods for increasing the carbon content and high alloying to increase the high temperature strength have increased the high temperature strength of hot work die steel to the limit, and will lead to a sharp decline in plastic toughness, high temperature fatigue and cold-thermal fatigue.

In view of this, the application provides a hot-work die steel and a preparation method thereof. The inventor found that the stability of coherent relationship between carbide and matrix at high temperature is decisive to the strength at high temperature. On this basis, carbon and alloy elements are selected, and the heat treatment parameters of the thermal process are decided. Multi-element alloying design of W, Mn, Mo, V, Cr, Ni and Nb and optimization of heat treatment process are performed, thereby degree of mismatch in the carbide/matrix interface is regulated to obtain a nanoscale MC type alloy carbide with low degree of mismatch which is distributed dispersedly. The coherent relationship between carbide and matrix allows stability at 700° C. by hindering dislocation motion and recrystallization of lath sorbite, thereby allowing high strength at high temperature. At the same time, low carbon content design (C content of 0.20-0.32%) is included in the application, and a quenched fine-grain structure of dislocation martensite is obtained through the heat treatment of fine grain step to ensure the toughness and fatigue resistance of the tempered material. Therefore, the service life of the novel steel is promised due to the organized structure.

The present application provides a hot-work die steel, comprising following chemical constituents:

C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, wherein an alloying degree is 5-7%;

wherein, a tensile strength of the hot-work die steel at 700° C. is 560-700 MPa, preferably 600-700 MPa, and more preferably 650-690 MPa;

wherein a value of hardness of the hot-work die steel at room temperature is 32-38 HRC after holding at 700° C. for 3-5 h; wherein the holding time is not specifically defined, for example, 3-5 h; specifically, the holding time can be 3 h, 4 h, or 5 h, preferably 4 h; and wherein, the hot-work die steel has an elongation of 14% to 16% at room temperature, a percentage reduction of area of 48% to 65%, and an impact toughness of 52-63 J at room temperature.

The inventor found through research that carbon (C) is an important element in the hot-work die steel, which is decisive with regard to the hardness and strength of the martensite formed by quenching, plays a key role of secondary hardening during tempering, and has important influence on the strength and toughness of the hot-work die steel. Not limited by any theory, the quenched structure of low carbon steel is usually dislocation martensite, which has not only high toughness, but also certain ability of plastic deformation, so that the formation of quenching cracks can be avoided and reduced. However, acicular martensite formed from high carbon steel in an explosive manner, which has great stress, and a twin martensite has a low toughness, thus, plastic deformation is impossible, and microscopic cracks often appear during quenching.

Based on the above research, the carbon content needs to be designed at low carbon level. If the carbon content in the matrix is under 0.25 wt %, structure of full lath martensite can be obtained after quenching. In view of carbon consumption during the formation of a first carbide from strong carbide forming elements, such as Mo, W, V and the like, the carbon content of the hot-work die steel of the present application is controlled in the range of 0.20-0.32 wt %. Accordingly, it will meet the requirement to facilitate the mass production of hot-work die steel, while improving the toughness and fatigue performance of the material.

The inventors also found through research that both silicon (Si) and manganese (Mn) are mainly used for deoxidation in the steel, and have certain effects of solution strengthening and improving the hardenability. Si exhibits good solution strengthening effect. A small amount of Si allows good solution strengthening effect. However, too much Si can reduce the toughness of the material sharply. Mn is an austenitizing forming element. However, too much Mn can lead to residual austenite in the material after quenching. Since excessive residual austenite material is harmful to the performance of the material at high temperature, the contents of Si and Mn in this application are controlled to: Si≤0.5 wt %, Mn≤0.5 wt %.

The main effect of chromium (Cr) is to increase the strength, hardenability and oxidation resistance of steel. In addition, Cr is a carbide forming element, which can form a variety of carbides with carbon, such as $Cr_7C_3$, $Cr_{23}C_6$, etc. However, high Cr content is not conducive to improve the high temperature strength of the steel, since high degree of mismatch is between those carbides and the matrix, in which the coherent relationship is impossible to maintain at high temperature, and those carbides are easy to grow up and become coarsened. Therefore, the content of Cr in the present application is controlled in the range of 1.5-2.8 wt %.

Tungsten (W) and molybdenum (Mo) can not only improve the hardenability of materials, but also form a large amount of $W_2C$ and $Mo_2C$ carbides with high melting point in the material. They can even dissolve in carbide VC to form an alloy carbide, which shows the secondary hardening effect, and can suppress aggregation and growing up of the carbide, so as to improve the high temperature strength. However, too much W and Mo will lead to high degree of mismatch between carbide and matrix at high temperature, so that the coherent relationship no longer exists. In this case, the formation of carbides, such as $M_6C$, which is easy to grow up and become coarsened is promoted, leading to failure of strengthening effect at high temperature. In this application, the Mo, W, and V contents are coordinated through adjusting the Mo content to 1.5-2.5 wt %, and adjusting the W content to 0.5-1.2 wt % to form a MC type alloy carbide which can maintain coherent relationship with the matrix with low degree of mismatch at high temperature, thereby improving the high temperature strength of the hot-work die steel.

Vanadium (V) is a strong carbide forming element. The small carbide particles formed from V are distributed dispersedly and require a temperature above 1200° C. to completely dissolve in austenite, and thus reducing the grain size of the austenite, resulting in a MC type alloy carbide with proper degree of mismatch between the carbide and the matrix. However, high vanadium content will lead to formation of a coarsened first carbide, which will significantly decrease the plasticity and toughness of the steel. The inventor accidentally found that it is beneficial to control the V content to 0.15-0.7 wt % that the coherent relationship between carbide and matrix at high temperature can be maintained at 700° C. with the coordinated W, Mo and V elements, and thereby significantly enhance the high temperature strength and thermal stability of the hot-work die steel, and that the plasticity and toughness of the hot-work die steel can also be improved.

Nickel (Ni) can effectively increase the hardenability of steel, and improve the low temperature toughness of steel. It will increase the cost and decrease the critical point Ac1 of the hot-work die steel by adding excessive Ni, which is adverse to the red hardness. Therefore, the Ni content is controlled in the range of 0.5-1.6% wt in this application.

Niobium (Nb) is preferred to combine with C to form a strong carbide, which controls the growth of grain during austenitizing at high temperature, and reduces the grain size. However, if the content is too high, too many first carbides are formed and the size is large when the material is solidified, which is not conducive to the improvement of the impact toughness and fatigue performance of the hot work die steel. Therefore, the content of Nb is controlled in the range of 0.01-0.1 wt % in the present application to take full advantage of the reduced grain size.

In an embodiment of the present application, the hot-work die steel further comprises at least one of the following chemical constituents:

Zr: 0.01-0.03 wt %, Co: 0.10-0.50 wt %, B: 0.001-0.005 wt %, Re: 0.01-0.10 wt %, Ti: 0.02-0.06 wt %, and Y: 0.01-0.1 wt %.

The inventor also found through research that, without limited by any theory, the high temperature stability, purity and grain size of the hot-work die steel can be further improved, when at least one of Zr, Co, B, Re, Ti and Y mentioned above is comprised in the hot-work die steel. It may be due to the following reasons:

Zirconium (Zr) has strong effects of deoxidizing and denitrogenation in steelmaking process. Therefore, it is possible to add a small amount of Zr to be combined with oxygen and nitrogen to obtain tiny dispersed oxides and nitrides in the matrix, which is favorable for reducing the grain size and minimizing the structure in the smelting process. In addition, Zr element can also combine with impurity element S to generate a sulfide, avoiding hot brittle of the steel. Therefore, in order to obtain a steel with smaller grain size for the structure and better purity, Zr content is controlled in the range of 0.01-0.03% wt.

Similar to Ni and Mn, cobalt (Co) is able to form continuous solid solution with iron, which may obstacle and delay the precipitation and accumulation of other alloy carbides in tempering process. Therefore, the hot strength of the material is significantly enhanced. However, since cobalt element reduces the hardenability of martensite steel, it should not be added too much. Therefore, the cobalt content is controlled in the range of 0.10-0.50 wt % in this application.

Boron (B) within a certain content range has significantly strong ability to improve hardenability of the steel. However, the hardenability is not greatly improved when boron exceeds 0.005 wt % in steel. In addition, B has the effect of strengthening grain boundary in the steel, and can significantly improve the high temperature strength of the material. Therefore, B content is controlled in the range of 0.001-0.005 wt % in the present application.

Rhenium (Re), which is a rare earth element, has the ability of controlling the morphology of sulphide in the steel, and also has effects of deoxidization, desulphurization, and improving the lateral performance and low temperature toughness, and the effects of dispersion and hardening in low-sulfur steel. Therefore, the Re content is controlled in the range of 0.01-0.10 wt % in the present application in order to deoxidize and desulfurize steel and purify liquid steel, and improve the strength and toughness of the steel.

Titanium (Ti) is preferred to combine with C to form a strong carbide, which controls the growth of grain during austenitizing at high temperature, and reduces the grain size. However, if the content is too high, too many first carbides are formed and the size is large when the material is solidified, which is not conducive to the improvement of the impact toughness and fatigue performance of the hot work die steel. Therefore, the content of Ti is controlled in the range of 0.02-0.06 wt % in the present application to take advantage of the reduced grain size.

Traces of yttrium (Y) content in the steel at high temperatures may be clustering in the grain boundary, which can strengthen the grain boundary at high temperature, improve the high temperature strength. Therefore, the Y content is controlled in 0.001-0.1 wt % in the present application.

Sulphur (S) and phosphorus (P) are the impurity elements, which are adverse to toughness of the material. This may be due to S reduces plasticity by forming a sulfide inclusion and leads to crack phenomenon by forming (Fe+FeS) cocrystal in sulfur-containing atmosphere. Therefore, the S content should be reduced as much as possible. High P content can result in reduction of toughness at low temperature and high ductile-brittle transition temperature. Therefore, the P content should also be reduced to the most extent in order to avoid or mitigate adverse impacts on the plasticity of the steel. However, the lower the content of S and P in the steel, the higher the cost of removing these elements. The contents of S and P in the application are controlled to be less than 0.02 wt % and less than 0.02 wt %, respectively, in order to ensure the excellent performance of hot-work die steel and to reduce the production cost thereof as much as possible to facilitate large-scale production.

In an embodiment of the present application, the tempered sorbite structure still retains the lath characteristic after the hot-work die steel is stretched at 700° C. High density of nanoscale MC type alloy carbide is distributed inside the lath, which indicates that the nanoscale carbide has higher thermal stability in the hot-work die steel of the present application.

In an embodiment of the present application, the carbide in the hot-work die steel is a nanoscale acicular MC type alloy carbide at 700° C. The carbide is identified as $V_{0.5\text{-}0.8}Mo_{0.5\text{-}0.6}Cr_{0.15\text{-}0.3}W_{0.06\text{-}0.14}Nb_{0.01\text{-}0.02}C$ multi-alloyed carbide through atomic probe analysis. Not limited to any theory, the carbide can keep a coherent relationship with the matrix at high temperature, so as to achieve high strength at high temperature of low alloyed hot-work die steel.

The present application provides a hot-work die steel, which has a tensile strength of 560-700 MPa at 700° C., and a hardness of 32-38 HRC after holding at 700° C. for 3-5 h, and thereby improving the operating temperature of the hot-work die steel by 100° C. to about 700° C., compared to that of existing hot-work die steel of 600° C. Therefore, the stability of the hot-work die steel is enhanced during operation at much higher temperature. In addition, the hot-work die steel in the present application has good plasticity and toughness at room temperature, thus expanding the application range of the hot-work die steel.

The present application also provides a method for producing the hot-work die steel according to any one of the above embodiments, comprising the following steps:

Smelting Step:

preparing the raw material according to following: C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, and then processing the raw material into an electrode rod by arc smelting, secondary refining, vacuum degassing, and forging.

The preparation process of the electrode rod is well known to those skilled in the art, and there is no specific limitation in this application. For example, the electrode rod can be prepared by mixing the above raw materials, and forging into the electrode rod in turn by arc smelting (EAF), secondary refining (LF), vacuum degassing (VD) and forging in forging furnace. There is no specific limitation to the above arc smelting, secondary refining, vacuum degassing and forging in the present application, provided that the objects of the present application can be achieved. For example, the discharge temperature of arc smelting can be equal to or higher than 1690° C., and the gas content and impurity element content in liquid steel shall be controlled to be: [nitrogen (N)]+[hydrogen (H)]+[oxygen (O)]≤150 ppm. The heating temperature of the secondary refining is 1600-1700° C. High basicity reductive slag can be produced in the refining process, and desulfurization can be enhanced by controlling the temperature. The vacuum degassing time is 15-20 min. The heating temperature is 1560-1675° C. The absolute vacuum degree is 50-100 Pa.

Electroslag Remelting Step:

removing an oxidized layer of the electrode rod, then introducing the electrode rod into a vacuum electroslag remelting device for secondary refining, holding the temperature of water in the water cooling system of the electroslag remelting device not higher than 70° C. to obtain an electroslag ingot by electroslag remelting from the electrode rod. There is no specific limitation to electroslag remelting in the present application, as long as the object of the application can be achieved. For example, the melting rate can be 7-12 kg/min; the water temperature of cooling water in the crystallizer is held at 40-50° C.; the deoxidizer can be at least one of aluminum particles or calcium silicate powder; and inert gas, such as argon, is filled throughout the electroslag remelting process.

The inventor found through research that the obtained electroslag ingot structure is more uniform and finer with higher purity when the temperature of the cooling water of the crystallizer of the electroslag remelting device is not higher than 70° C.

Homogenization and Annealing Step:

heating the electroslag ingot to 1200-1250° C. and holding for 15-23 h;

Forging Step:

cooling the electroslag ingot to a forging heating temperature of 1150-1200° C. and then forging to obtain an ingot, wherein the initial forging temperature is 1130 to 1160° C., and the final forging temperature is ≥850° C.

The forging heating temperature of the present application is increased by about 50° C. compared with that of the existing die steel, so as to improve the high-temperature solid solubility of carbon and alloy elements, and to make grains and structure fine after forging.

Annealing after Forging Step:

introducing the ingot into an annealing furnace after the temperature of the ingot is lower than 500° C., heating to 830-890° C. at a heating rate of not more than 100° C./h, holding for [120 min+r (mm)×2 min/mm] or [120 min+d (mm)/2×2 min/mm], wherein the specific holding time can be determined according to the size of the material, preferably 6-8 h, lowering the temperature to below 500° C. at a cooling rate of 20-40° C./h, taking the ingot out from annealing furnace, and air-cooling to obtain an annealed ingot;

wherein r is a radius of the material and d is a thickness of the material. When the ingot is a cylinder, the above r can be used to calculate the holding time. When the ingot is a cube, the above d can be used to calculate the holding time, wherein the specific calculation method is determined according to the actual shape of the material. Moreover, cooling the ingot to a lower temperature (such as lower than 500° C.) and then annealing may avoid the grain from coarsening caused by holding too long at high temperature.

Heat Treatment of Fine Grain Step:

Referring to FIG. 1, which is a process chart of the heat treatment process for the hot-work die steel in the present application, heating the annealed ingot to 930-1150° C. and performing a first holding for a first holding time of [(15-40) min+r (mm)×2 min/mm] or [(15-40) min+d (mm)/2×2 min/mm], wherein the specific first holding time can be determined according to the size of the material, and the above process is a normalizing process, after that, water cooling to 400-500° C. within 1-2 min, then air cooling to 250-280° C. and performing a second holding for a second holding time of 5-10 h; and then holding at a temperature of 660-700° C. for 5-10 h;

wherein r is a radius of the material and d is a thickness of the material. When the ingot is a cylinder, the above r can be used to calculate the holding time. When the ingot is a cube, the above d can be used to calculate the holding time, wherein the specific calculation method is determined according to the actual shape of the material.

In the present application, the process of water cooling after normalizing to 400-500° C. and air cooling to 250-280° C. for 5-10 h is adopted to refine grains by forming B/M (Bainite/martensite) duplex structure, and then dispersive secondary carbides are formed by holding at 660-700° C. to hinder the growth of austenite grain during subsequent tempering heating. The inventor unexpectedly found that the high temperature tensile strength of the material is higher compared with that obtained by the present heat treatment methods. This may be due to the fact that the fine grain heat treatment method of the present application can refine the grain while improving the solid solubility of the material.

Tempering Treatment Step:

heating the held ingot to 980-1100° C., holding for [(15-40) min+r (mm)×2 min/mm] or [(15-40) min+d (mm)/2×2 min/mm], then cooling to 50-150° C.; and then tempering and holding at 580-660° C. for 6-16 h to obtain the hot-work die steel.

The heating temperature in the tempering treatment step of the application is increased by 30-50° C. compared with that of the existing hot-work die steel, so as to improve the solid solubility of alloy elements. In addition, there is no specific limitation to the cooling method of the tempering treatment step in the present application. It can be such as air cooling, water cooling or oil cooling.

In the tempering and holding step of the application, tempering at 580-660° C. allows the hot-work die steel to form a nanoscale MC type alloy carbide with low mismatch degree, and further improves the thermal stability of the material.

In an embodiment of the present application, the raw material further comprises at least one of the following constituents:

Zr: 0.01-0.03 wt %, Co: 0.10-0.50 wt %, B: 0.001-0.005 wt %, Re: 0.01-0.10 wt %, Ti: 0.02-0.06 wt %, and Y: 0.01-0.1 wt %.

In an embodiment of the present application, the forging step may include:

using a precision forging machine for forming and forging, with the forging heating temperature of 900-1050° C., the initial forging temperature of 850-950° C., and the final forging temperature ≥800° C.; alternatively, the forging heating temperature of 1150-1200° C., the initial forging temperature of 1130-1160° C., and the final forging temperature ≥850° C., so as to obtain the forgings with appropriate shape and size.

There is no specific limitation to the model of the precision forging machine, hydraulic hammer or hydraulic press, so long as the purpose of the application can be achieved, for example, the precision forging machine produced by GFM company in Austria can be used.

The present application provides a heat treatment process for the hot-work die steel, wherein the hot-work die steel is allowed to have the tensile strength of 560-700 MPa at 700° C. and the value of hardness of 32-38 HRC at room temperature after holding for 3-5 h at 700° C. by controlling the addition proportion of each raw material and reasonable forging and heat treatment process. Moreover, the hot-work die steel in the present application has good plasticity and toughness at room temperature, which expands the application range of the hot-work die steel.

In the following, examples and comparative examples are illustrated to explain the implementation mode of the application more specifically. Various tests and evaluations are carried out according to the following methods. In addition, "parts" and "%" are the weight basis unless otherwise indicated.

Example 1

<Smelting>

The raw material was prepared according to the following mass percentages:

C: 0.19 wt %, Si: 0.20 wt %, Mn: 0.30 wt %, Cr: 2.22 wt %, Mo: 2.30 wt %, W: 0.50 wt %, Ni: 0.50 wt %, V: 0.22 wt %, Nb: 0.20 wt %, and a balance of iron, and the raw material was processed into an electrode rod by arc smelting, refining, vacuum degassing, and forging in forging furnace.

<Electroslag Remelting>

The oxidized layer of the electrode rod was removed, then the electrode rod was introduced into a vacuum electroslag remelting device. The temperature of water in the water cooling system of the electroslag remelting device was held at 70° C. to obtain an electroslag ingot by electroslag remelting from the electrode rod.

<Homogenization Annealing>

The electroslag ingot was heated to 1200° C. for 23 h.

<Forging>

The electroslag ingot was cooled to a forging heating temperature of 1150° C. and then forged to obtain an ingot. The initial forging temperature is 1130° C., and the final forging temperature is 850° C. The ingot had a radius of 40 mm and a length of 100 mm.

<Annealing after Forging>

The ingot was introduced into an annealing furnace under the temperature of lower than 500° C., heated to 830° C. at a heating rate of 80° C./h, held for 200 min. Then, lowering the temperature to below 450° C. at a cooling rate of 20° C./h, taking the ingot out from annealing furnace, and air-cooling to obtain an annealed ingot.

<Heat Treatment of Fine Grain>

The annealed ingot was heated to 930° C. for a first holding, wherein a first holding time was 2 h, water cooled to 400° C. within 1 min, then air cooled to 250° C. for a second holding, wherein a second holding time was 10 h; and then held at a temperature of 660° C. for 10 h.

<Tempering Treatment>

The held ingot was heated to 1000° C., held for 2 h, then quenched to 50° C., and then tempered at 600° C. for 16 h to obtain the hot-work die steel.

Example 2

<Smelting>

The raw material was prepared according to the following mass percentages:

C: 0.23 wt %, Si: 0.20 wt %, Mn: 0.30 wt %, Cr: 2.48 wt %, Mo: 2.15 wt %, W: 0.50 wt %, Ni: 0.50 wt %, V: 0.28 wt %, Nb: 0.10 wt %, and a balance of iron, and the raw material was processed into an electrode rod by arc smelting, refining, vacuum degassing, and forging in forging furnace.

<Electroslag Remelting>

The oxidized layer of the electrode rod was removed, then the electrode rod was introduced into a vacuum electroslag remelting device. The temperature of water in the water cooling system of the electroslag remelting device was held at 65° C. to obtain an electroslag ingot by electroslag remelting from the electrode rod.

<Homogenization Annealing>

The electroslag ingot was heated to 1230° C. for 20 h.

<Forging>

The electroslag ingot was cooled to a forging heating temperature of 1170° C. and then forged to obtain an ingot. The initial forging temperature is 1150° C., and the final forging temperature is 860° C. The ingot had a radius of 40 mm and a length of 100 mm.

<Annealing after Forging>

The ingot was introduced into an annealing furnace under the temperature of lower than 500° C., heated to 850° C. at a heating rate of 90° C./h, held for 200 min. Then, lowering the temperature to below 480° C. at a cooling rate of 30° C./h, taking the ingot out from annealing furnace, and air-cooling to obtain an annealed ingot.

<Heat Treatment of Fine Grain>

The annealed ingot was heated to 980° C. for a first holding, wherein a first holding time was 2 h, water cooled to 450° C. within 1.5 min, then air cooled to 260° C. for a second holding, wherein a second holding time was 6 h; and then held at the temperature of 660° C. for 5 h.

<Tempering Treatment>

The held ingot was heated to 1020° C., held for 1.5 h, then quenched to 100° C., and then tempered at 620° C. for 10 h to obtain the hot-work die steel.

Example 3

<Smelting>

The raw material was prepared according to the following mass percentages:

C: 0.27 wt %, Si: 0.04 wt %, Mn: 0.07 wt %, Cr: 2.72 wt %, Mo: 1.90 wt %, W: 0.95 wt %, Ni: 1.22 wt %, V: 0.40 wt %, Nb: 0.10 wt %, Y: 0.02 wt % and a balance of iron, and the raw material was processed into an electrode rod by arc smelting, refining, vacuum degassing, and forging in forging furnace.

<Electroslag Remelting>

The oxidized layer of the electrode rod was removed, then the electrode rod was introduced into a vacuum electroslag remelting device. The temperature of water in the water cooling system of the electroslag remelting device was held at 68° C. to obtain an electroslag ingot by electroslag remelting from the electrode rod.

<Homogenization Annealing>

The electroslag ingot was heated to 1250° C. for 15 h.

<Forging>

The electroslag ingot was cooled to a forging heating temperature of 1200° C. and then forged to obtain an ingot. The initial forging temperature is 1160° C., and the final forging temperature is 870° C. The ingot had a radius of 40 mm and a length of 100 mm.

<Annealing after Forging>

The ingot was introduced into an annealing furnace under the temperature of lower than 500° C., heated to 900° C. at a heating rate of 100° C./h, held for 200 min. Then, lowering the temperature to below 490° C. at a cooling rate of 40° C./h, taking the ingot out from annealing furnace, and air-cooling to obtain an annealed ingot.

<Heat Treatment of Fine Grain>

The annealed ingot was heated to 1000° C. for a first holding, wherein a first holding time was 2 h, water cooled to 500° C. within 2 min, then air cooled to 280° C. for a second holding, wherein a second holding time was 6 h; and then held at a temperature of 680° C. for 5 h.

<Tempering Treatment>

The held ingot was heated to 1020° C., held for 1.5 h, then quenched to 150° C., and then tempered at 635° C. for 6 h to obtain the hot-work die steel.

Example 4

<Smelting>

The raw material was prepared according to the following mass percentages:

C: 0.30 wt %, Si: 0.12 wt %, Mn: 0.02 wt %, Cr: 2.00 wt %, Mo: 1.65 wt %, W: 1.10 wt %, Ni: 1.42 wt %, V: 0.42 wt %, Nb: 0.02 wt %, Zr: 0.02 wt %, Co: 0.10 wt %, B: 0.003 wt %, Re: 0.012 wt %, Ti: 0.03 wt %, Y: 0.02 wt % and a balance of iron, and the raw material was processed into an electrode rod by arc smelting, refining, vacuum degassing, and forging in forging furnace.

<Electroslag Remelting>

The oxidized layer of the electrode rod was removed, then the electrode rod was introduced into a vacuum electroslag remelting device. The temperature of water in the water cooling system of the electroslag remelting device was held at 69° C. to obtain an electroslag ingot by electroslag remelting from the electrode rod.

<Homogenization Annealing>

The electroslag ingot was heated to 1250° C. for 15 h.

<Forging>

The electroslag ingot was cooled to a forging heating temperature of 1200° C. and then forged to obtain an ingot. The initial forging temperature is 1160° C., and the final forging temperature is 870° C. The ingot had a radius of 40 mm and a length of 100 mm.

<Annealing after Forging>

The ingot was introduced into an annealing furnace under the temperature of lower than 500° C., heated to 900° C. at a heating rate of 100° C./h, held for 200 min. Then, lowering the temperature to below 490° C. at a cooling rate of 40° C./h, taking the ingot out from annealing furnace, and air-cooling to obtain an annealed ingot.

<Heat Treatment of Fine Grain>

The annealed ingot was heated to 1100° C. for a first holding, wherein a first holding time was 2 h, water cooled to 500° C. within 2 min, then air cooled to 270° C. for a second holding, wherein a second holding time was 6 h; and then held at the temperature of 700° C. for 5 h.

<Tempering Treatment>

The held ingot was heated to 1050° C., held for 1 h, then quenched to 100° C., and then tempered at 640° C. for 6 h to obtain the hot-work die steel.

Example 5

<Smelting>

The raw material was prepared according to the following mass percentages:

C: 0.32 wt %, Si: 0.30 wt %, Mn: 0.15 wt %, Cr: 2.75 wt %, Mo: 2.30 wt %, W: 0.65 wt %, Ni: 0.63 wt %, V: 0.70 wt %, Nb: 0.04 wt %, Y: 0.01 wt % and a balance of iron, and the raw material was processed into an electrode rod by arc smelting, refining, vacuum degassing, and forging in forging furnace.

<Electroslag Remelting>

The oxidized layer of the electrode rod was removed, then the electrode rod was introduced into a vacuum electroslag remelting device. The temperature of water in the water cooling system of the electroslag remelting device was held at 66° C. to obtain an electroslag ingot by electroslag remelting from the electrode rod.

<Homogenization Annealing>

The electroslag ingot was heated to 1230° C. for 20 h.

<Forging>

The electroslag ingot was cooled to a forging heating temperature of 1180° C. and then forged to obtain an ingot. The initial forging temperature is 1140° C., and the final forging temperature is 870° C. The ingot had a radius of 40 mm and a length of 100 mm.

<Annealing after Forging>

The ingot was introduced into an annealing furnace under the temperature of lower than 500° C., heated to 850° C. at a heating rate of 95° C./h, held for 200 min. Then, lowering the temperature to below 485° C. at a cooling rate of 35° C./h, taking the ingot out from annealing furnace, and air-cooling to obtain an annealed ingot.

<Heat Treatment of Fine Grain>

The annealed ingot was heated to 1140° C. for a first holding, wherein a first holding time was 2 h, water cooled to 430° C. within 1 min, then air cooled to 270° C. for a second holding, wherein a second holding time is 6 h; and then held at the temperature of 680° C. for 5 h.

<Tempering Treatment>

The held ingot was heated to 1050° C., held for 1 h, then quenched to 70° C., and tempered at 580° C. for 4 h and then secondly tempered at 640° C. for 2 h to obtain the hot-work die steel.

Example 6

The raw material comprised W of 1.00 wt %, Ni of 1.22 wt %, V of 0.60 wt %, Nb of 0.02 wt %, Zr of 0.01 wt %, Co of 0.20 wt %, B of 0.001 wt %, Re of 0.05 wt %, Ti of 0.04 wt %, and Y of 0.02 wt %, other constituents were the same as that of Example 5.

Example 7

The raw material comprised Cr of 1.5 wt %, W of 1.00 wt %, Ni of 1.22 wt %, V of 0.60 wt %, Nb of 0.02 wt %, Zr of 0.03 wt 0%, Co of 0.40 wt %, B of 0.005 wt %, Re of 0.10 wt %, Ti of 0.06 wt %, Y of 0.10 wt %, other constituents were the same as that of Example 5.

Comparative Example 1

This Comparative Example provided a H13 hot-work die steel, of which the specification was 40 mm in radius and 100 mm in length. The heat treatment process thereof included the following steps:

quenching: the forged ingot was heated to 1050° C., held for 1 h, and water cooled; tempering: the quenched ingot was heated to 590° C., held for 2 h, then heated to 620° C. and then held for 2 h.

Comparative Example 2

This Comparative Example provided a 3Cr2W8V hot-work die steel, of which the specification was 40 mm in radius and 100 mm in length. The heat treatment process thereof included the following steps:

quenching: the forged ingot was heated to 1130° C., held for 1 h, and water cooled; tempering: the quenched ingot was heated to 610° C., held for 2 h, then heated to 630° C. and then held for 2 h.

<Performance Test>

High Temperature Strength Test:

The hot-work die steels in Examples 1-7 and Comparative Examples 1-2 were tested for the high temperature tensile strength at 700° C. according to GB/T4338-2006, *High temperature tensile test method for metallic materials*. The test results are shown in Table 2.

Thermal Stability Test:

The hot-work die steels in Examples 1 and 5 and Comparative Examples 1-2 were tested for the room temperature Rockwell hardness (HRC) after holding at different temperatures for 4 h. The test results are shown in Table 3.

Room Temperature Performance Test:

The hot-work die steels in Examples 1 and 5 and Comparative Examples 1-2 were tested for the room temperature tensile performances and impact toughness (U-shape notch). The test results include elongation (A), percentage of reduction of area (z) and room temperature impact toughness ($A_{ku}$), as shown in Table 4.

Fracture Toughness Test:

The compact tensile samples of Examples 1 and 5 and Comparative Examples 1-2 were selected and tested on the fatigue test platform (MTS810) according to GB/T 4161-2007, *Experimental method for plane strain fracture toughness $K_{IC}$ of metallic materials*. The test results are shown in Table 5.

High Temperature Strain Fatigue Life Test:

Example 5 and Comparative Example 1 were selected for the fatigue life test carried out on MTS NEW810 electro-hydraulic servo fatigue testing machine according to GB/T15248-2002, *Axial constant amplitude low cycle fatigue test method for metallic materials*. The results are shown in Table 6.

TABLE 1

Constitutions of the hot-work die steel in each Example or Comparative Example of the application

| Element content/% | Example 1 | Example 2 | Example 3 | Example 4 | Example 5 | Example 6 | Example 7 | Comparative Example 1 (H13) | Comparative Example 2 (3Cr2W8V) |
|---|---|---|---|---|---|---|---|---|---|
| C | 0.19 | 0.23 | 0.27 | 0.30 | 0.32 | 0.32 | 0.32 | 0.40 | 0.36 |
| Si | 0.20 | 0.20 | 0.04 | 0.12 | 0.30 | 0.30 | 0.30 | 1.0 | 0.21 |
| Mn | 0.30 | 0.30 | 0.07 | 0.02 | 0.15 | 0.15 | 0.15 | 0.3 | 0.28 |
| Cr | 2.22 | 2.48 | 2.72 | 2.00 | 2.75 | 2.75 | 1.50 | 5.00 | 2.52 |
| Mo | 2.30 | 2.15 | 1.90 | 1.65 | 2.30 | 2.30 | 2.30 | 0.46 | — |
| W | 0.50 | 0.50 | 0.95 | 1.10 | 0.65 | 1.00 | 1.00 | — | 8.18 |
| Ni | 0.50 | 0.50 | 1.22 | 1.42 | 0.63 | 1.22 | 1.22 | — | 0.06 |
| V | 0.22 | 0.28 | 0.40 | 0.42 | 0.70 | 0.60 | 0.60 | 0.19 | 0.32 |
| Nb | 0.20 | 0.10 | 0.10 | 0.02 | 0.04 | 0.02 | 0.02 | — | — |
| Zr | — | — | — | 0.02 | — | 0.01 | 0.03 | — | — |
| Co | — | — | — | 0.10 | — | 0.20 | 0.40 | — | — |
| B | — | — | — | 0.003 | — | 0.001 | 0.005 | — | — |
| Re | — | — | — | 0.012 | — | 0.05 | 0.10 | — | — |
| Ti | — | — | — | 0.03 | — | 0.04 | 0.06 | — | — |
| Y | — | — | 0.02 | 0.02 | 0.01 | 0.02 | 0.10 | — | — |
| Fe | Balance | Balance | Balance | Balance | Balance | Balance | Balance | Balance | Balance |

TABLE 2

Test results of high temperature strength of the hot-work die steel in each Example or Comparative Example

| Example | $R_m$ (MPa) | $R_{p0.2}$ (MPa) |
|---|---|---|
| Example 1 | 560 | 345 |
| Example 2 | 621 | 405 |
| Example 3 | 634 | 410 |
| Example 4 | 642 | 420 |
| Example 5 | 678 | 450 |
| Example 6 | 687 | 466 |
| Example 7 | 694 | 483 |
| Comparative Example 1 | 292 | 255 |
| Comparative Example 2 | 415 | 364 |

TABLE 3

Hardness (unit HRC) of Examples 1 and 5 and Comparative Examples 1-2

| Steel Grade | 600° C. | 620° C. | 660° C. | 700° C. |
|---|---|---|---|---|
| Example 1 | 45 | 43.5 | 39 | 32 |
| Example 5 | 47 | 45.1 | 41.3 | 37.2 |
| Comparative Example 1 | 47 | 40.2 | 31 | 24 |
| Comparative Example 2 | 41 | 46 | 38.2 | 29.8 |

TABLE 4

Room temperature tensile performance of Examples 1 and 5 and Comparative Examples 1-2

| Steel Grade | $R_m$ (MPa) | $R_{p0.2}$ (MPa) | A (%) | Z (%) | $A_{ku}$ (J) |
|---|---|---|---|---|---|
| Example 1 | 1310 | 1020 | 16 | 62 | 63 |
| Example 5 | 1350 | 1050 | 14 | 48.3 | 52 |
| Comparative Example | 1389 | 1189 | 11.2 | 43.7 | 21.0 |
| Comparative Example 2 | 1647 | 1449 | 10 | 30.8 | 13 |

TABLE 5

Test results of fracture toughness of Examples 1 and 5 and Comparative Examples 1-2

| Steel Grade | Hardness (HRC) | $K_{IC}$ (MPa · $m^{0.5}$) |
|---|---|---|
| Example 1 | 41 | 144.2 |
| Example 5 | 46 | 107.8 |
| Comparative Example 1 | 44 | 83.2 |
| Comparative Example 2 | 49 | 32.7 |

TABLE 6

Test results of high temperature strain fatigue life of Example 5 and Comparative Example 1

| Steel Grade | Diameter of sample (mm) | Total strain amplitude | Frequency (Hz) | Load (KN) | Loading (GPa) | Service life (Times) |
|---|---|---|---|---|---|---|
| Example 5 | 6.50 | 0.2 | 0.5 | 1.0 | 127 | 12236 |
| | 6.48 | 0.4 | 0.25 | 1.0 | 126 | 990 |
| | 6.50 | 0.6 | 0.167 | 1.0 | 130 | 469 |
| Comparative | 6.50 | 0.2 | 0.5 | 1.0 | 113 | 9302 |
| Example 1 | 6.47 | 0.4 | 0.25 | 1.0 | 113 | 817 |
| | 6.50 | 0.6 | 0.167 | 1.0 | 119 | 417 |

It can be seen from Table 2 that the high-temperature strength at 700° C. of Examples 1-5 are higher than that of H13 steel and 3Cr2W8V steel of Comparative Example 1 and Comparative Example 2. Specifically, the high-temperature strength at 700° C. of Examples 1 increased by nearly 1 time and the high-temperature strength at 700° C. of Examples 2-5 increased by more than 1 time compared with that of Comparative Example 1; the high-temperature strength at 700° C. of Examples 1 increased by nearly 0.5 times, and the high-temperature strength at 700° C. of Examples 3-5 increased more than 0.5 times compared with that of Comparative Example 2, indicating that the hot-work die steel according to the present application has excellent high temperature strength.

It can be seen from Table 3 that the hardness reduction at room temperature of Examples 1 and 5 after holding for 4 h in the temperature range of 600-700° C. is less than that of H13 steel in Comparative Example 1 and 3Cr2W8V steel in Comparative Example 2, indicating that the hot-work die steel according to the application has high thermal stability.

It can be seen from Table 4 that the elongation (A), percentage of reduction of area (Z) and room temperature impact toughness ($A_k$) of Examples 1 and 5 are higher than that of H13 steel in Comparative Example 1 and that of 3Cr2W8V steel in Comparative Example 2, indicating that the hot-work die steel according to the application has good room temperature plasticity and toughness.

It can be seen from Table 5 that the hot-work die steels in Examples 1 and 5 have fracture toughness $K_{IC}$ of 107.8-144.2 MPa·$m^{0.5}$ under 41 HRC and 46 HRC, which increased to more than 1.3 times of that of H13 steel in Comparative Example 1 and more than 3 times of that of 3Cr2W8V steel in Comparative Example 2, indicating that the hot-work die steel according to the present application has good room temperature fatigue resistance.

It can be seen from table 6 that the fatigue life of sample with various diameter in example 5 is higher than that of H13 steel with the same diameter in Comparative Example 1 under the strain amplitude of 0.2%-0.6%, indicating that the hot-work die steel according to the present application has better high temperature low cycle fatigue resistance than H13 steel.

Figure 2:
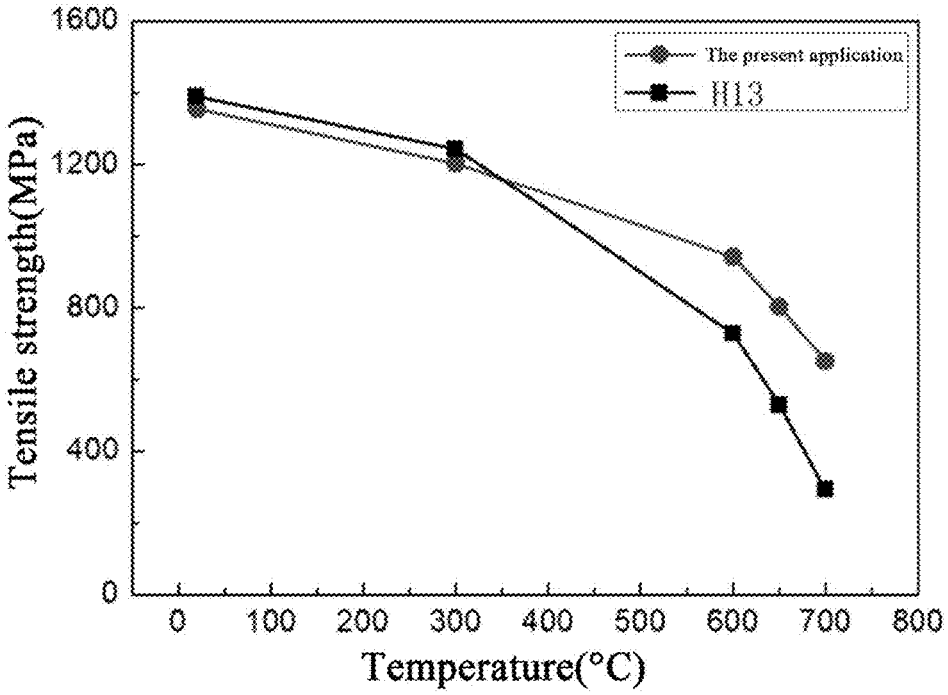
FIG. 2 is a schematic diagram of the tensile strength of the hot-work die steel in Example 5 of the present application and H13 steel in Comparative Example 1 as a function of the temperature.

FIG. 2 is the schematic diagram of the tensile strength varying with temperature of hot-work die steel produced in Example 5 of the present application and H13 steel of Comparative Example 1. In FIG. 2, the tensile strength of H13 steel rapidly decreases after the temperature exceeds 600° C., and the tensile strength at 700° C. is only 292 MPa. However, the tensile strength of the hot-work die steel in the application decreases slowly with the increase of temperature, and the tensile strength at temperature above 650° C. is higher than that of H13 steel. The tensile strength at 700° C. of the steel in the present application is about 700 MPa, which is about 2 times more than that of H13 steel.

Figure 3A:
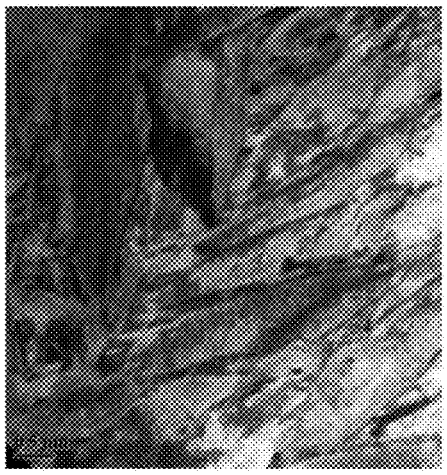
FIG. 3*a* is an electron microscope photo of the hot-work die steel in Example 5 of the present application at room temperature.
Figure 3B:
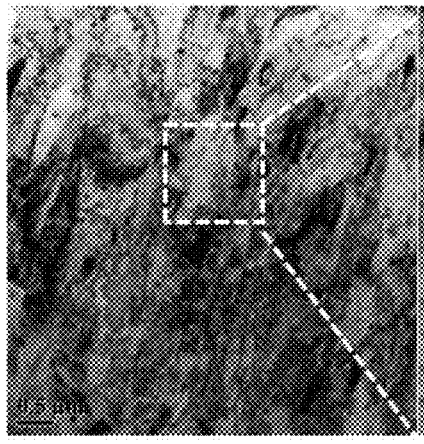
FIG. 3*b* is an electron microscope photo of the hot-work die steel in Example 5 of the present application after stretching at 700° C.
Figure 3C:
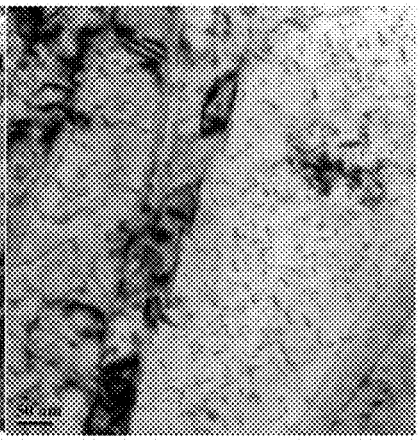
FIG. 3*c* is a partial enlargement of FIG. 3*b*.

FIG. 3*a* is the electron microscope photo of the hot-work die steel in Example 5 of the application at room temperature (25° C.). FIG. 3*b* is the electron microscope photo of the hot-work die steel of Example 5 of the application after stretching at 700° C. FIG. 3*c* is the partial enlargement of FIG. 3*b*.

Figure 4A:
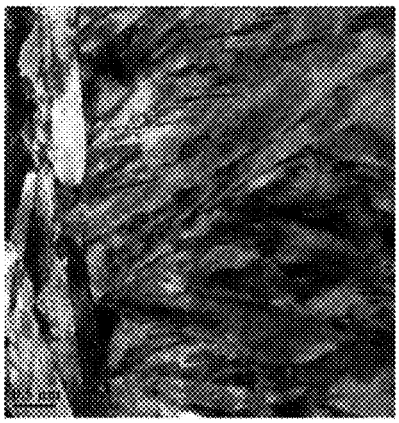
FIG. 4*a* is an electron microscope photo of H13 steel in Comparative Example 1 at room temperature.
Figures 4B, 4C:
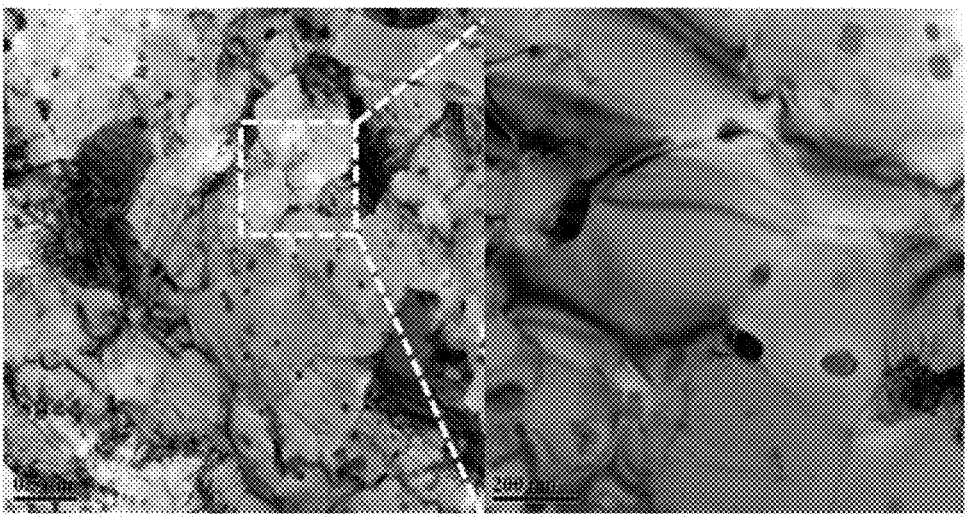
FIG. 4*b* is an electron microscope photo of H13 steel in Comparative Example 1 after stretching at 700° C.
FIG. 4*c* is a partial enlargement of FIG. 4*b*.

FIG. 4*a* is the electron microscope photo of H13 steel in Comparative Example 1 at room temperature. FIG. 4*b* is the electron microscope photo of H13 steel in Comparative Example 1 after stretching at 700° C. FIG. 4*c* is the partial enlargement of FIG. 4*b*.

It is shown that the tempered microstructure of the hot-work die steel in the present application and Comparative Example 1 both retain lath characteristic at room temperature, according to the comparison between FIG. 3*a* and FIG. 4*a*. However, after undergoing at 700° C., it is described that the hot-work die steel in the present application retains the lath characteristic with high density of nanoscale MC type alloy carbide distributed therein according to the comparison between FIG. 3*b* and FIG. 4*b* and the comparison between FIG. 3*c* and FIG. 4*c*, while the H13 steel in Comparative Example 1 is completely depleted of the lath characteristic, in which the carbides undergo coarsening and spheroidizing. It indicates that the nanoscale carbides in the present application have higher thermal stability and grow up slowly at 700° C. Therefore, the hot-work die steel in the present application has excellent thermal stability.

Figure 5A:
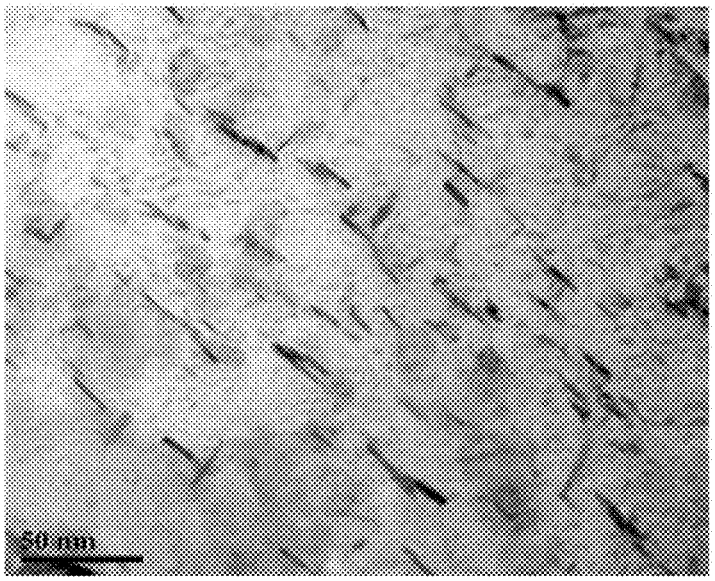
FIG. 5*a* is a micro topography of the carbide obtained from the hot-work die steel in Example 5 of the present application after stretching at 700° C.

FIG. 5*a* is a micro topography, specifically a bright field image of TEM, of the carbide obtained from the hot-work die steel in Example 5 of the present application after stretching at 700° C. As shown in FIG. 5*a*, the carbide is nanoscale acicular MC type alloy carbide.

Figure 5B:
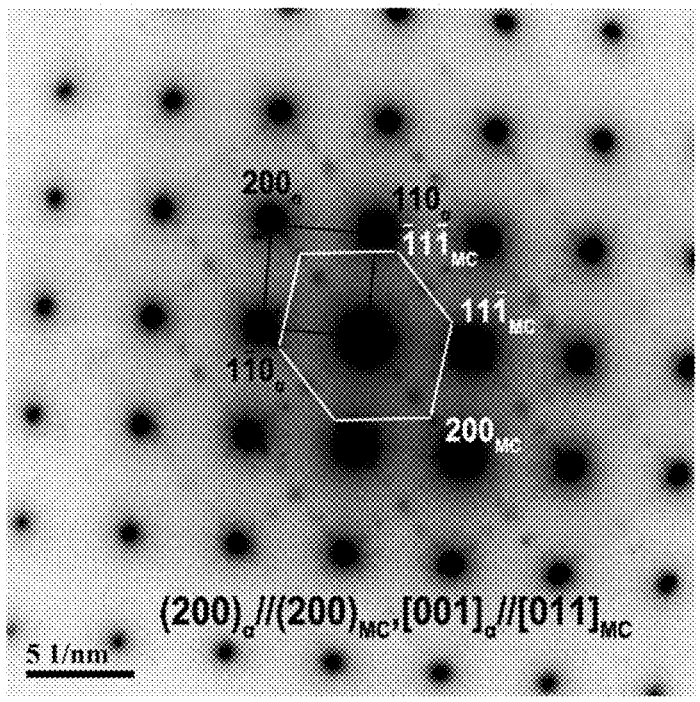
FIG. 5*b* is an electron diffraction pattern of the selected area of the hot-work die steel in Example 5 of the present application after stretching at 700° C.

FIG. 5*b* is the electron diffraction pattern of the selected area of the hot-work die steel in Example 5 of the present application after stretching at 700° C. As shown in FIG. 5*b*, the (200) plane of α matrix is parallel to (200) plane of MC carbide, while the [001] direction of α matrix is parallel to [011] direction of MC carbide, indicating that MC carbide still remains good B—N orientation relationship with a matrix at the temperature of 700° C.

Figure 5C:
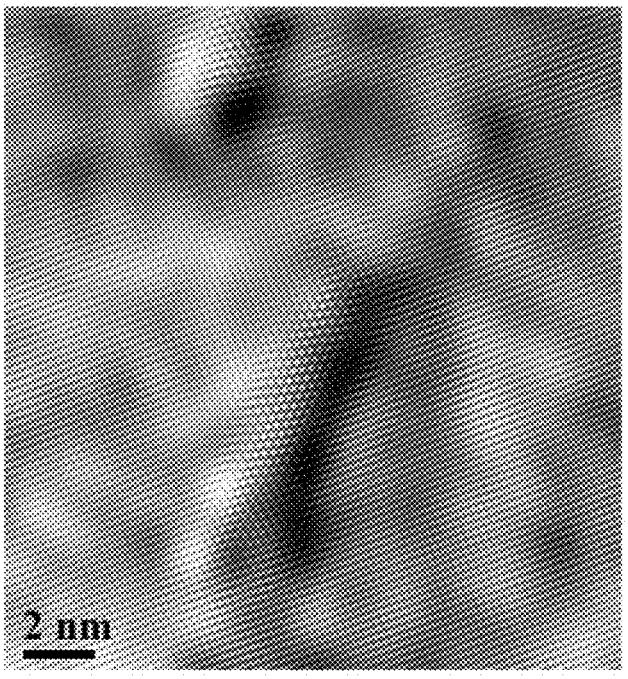
FIG. 5*c* is a high-resolution photo of the MC type alloy carbide obtained from the hot-work die steel in Example 5 of the present application after stretching at 700° C.

FIG. 5*c* is a high resolution photo of the MC type alloy carbide obtained from the hot-work die steel in Example 5 of the present application after stretching at 700° C. As shown in FIG. 5*c*, the interface between carbide/matrix still remains high level coherent relationship, indicating that the hot-work die steel according to the present application has excellent high temperature stability.

Figure 6:
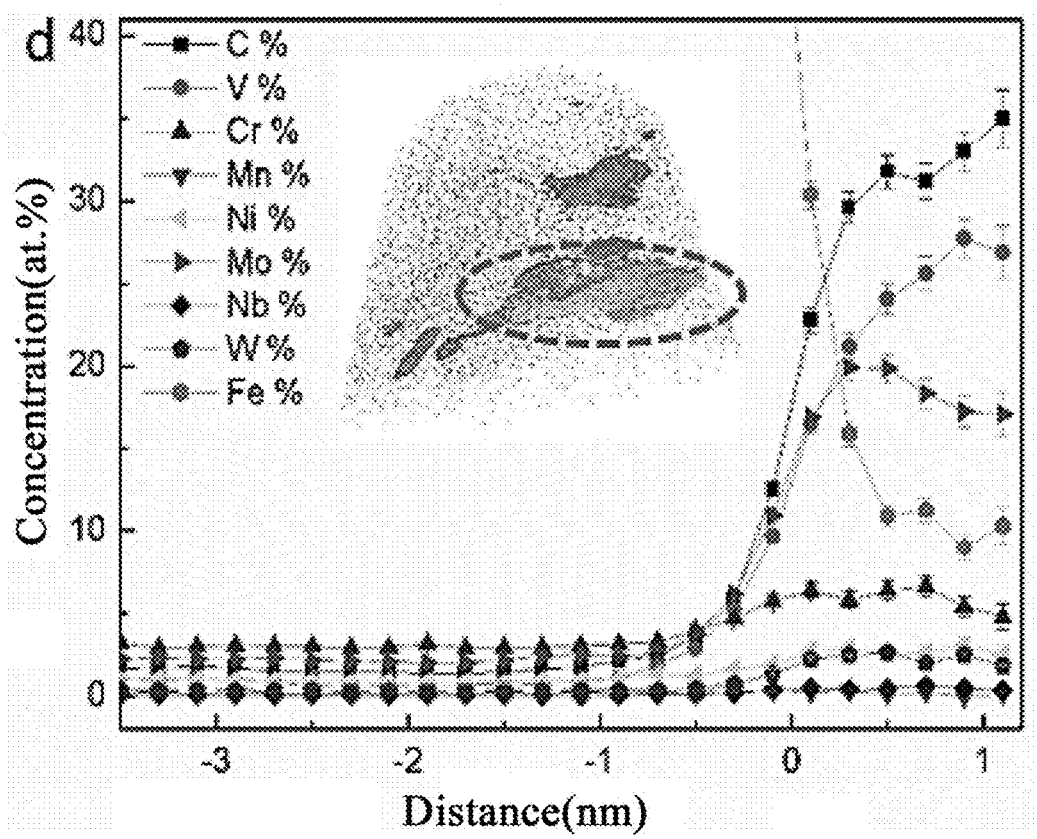
FIG. 6 is an analysis diagram of the constitution of the carbide obtained from the hot-work die steel in Example 5 of the present application.

FIG. 6 is the analysis diagram of the constitution of the carbide obtained from the hot-work die steel in Example 5 of the present application. The results of atom probe analysis shows that the carbide is a multi-element alloy carbide ($V_{0.5-0.8}M_{0.5-0.6}Cr_{0.15-0.3}W_{0.06-0.14}Nb_{0.01-0.02}C$), wherein the dotted box indicates that the constitution analysis comes from the carbide in this area. The coherent relationship between the specific carbide and the matrix is remained at a higher temperature, and thereby the steel in this application achieving high strength at high temperature under a low degree of alloying.

In conclusion, not bound to any theory, the inventor believes that the application can maintain the high-temperature coherent relationship between the carbide and the matrix of the hot-work die steel through the coordination of the constituents and the inventive heat treatment process, and achieve the adjustment and control of the mismatch degree of the carbide/matrix interface. The stability of the coherent relationship between the carbide and the matrix can be retained at 700° C., so as to improve the high-temperature tensile strength of the hot-work die steel.

Above are only preferred examples of the present application, which are not intended to limit the protection scope of this application. Any modifications, equivalent substitutions, improvements and the like made within the spirit and principles of the present application are included in the scope of the present application.

The invention claimed is:

1. A hot-work die steel, comprising the following chemical constituents:

C: 0.20-0.32 wt %, Si: ≤0.5 wt %, Mn: ≤0.5 wt %, Cr: 1.5-2.8 wt %, Mo: 1.5-2.5 wt %, W: 0.5-1.2 wt %, Ni: 0.5-1.6 wt %, V: 0.15-0.7 wt %, Nb: 0.01-0.1 wt %, and a balance of iron, wherein an alloying degree is 5-7 wt %;

wherein a tensile strength of the hot-work die steel at 700° C. is 560-700 MPa;

wherein a value of hardness of the hot-work die steel at room temperature is 32-38 HRC after holding at 700° C. for 3-5 h; and wherein the hot-work die steel has an elongation of 14% to 16% at room temperature, a percentage reduction of area of 48% to 65% at room temperature, and an impact toughness of 52-63 J at room temperature.

2. The hot-work die steel according to claim 1, wherein the hot-work die steel further comprises at least one of the following chemical constituents:

Zr: 0.01-0.03 wt %, Co: 0.10-0.50 wt %, B: 0.001-0.005 wt %, Re: 0.01-0.10 wt %, Ti: 0.02-0.06 wt %, and Y: 0.01-0.1 wt %.

3. The hot-work die steel according to claim 1, wherein the hot-work die steel comprises less than 0.02 wt % of S and less than 0.02 wt % of P.

4. The hot-work die steel according to claim 1, wherein the hot-work die steel comprises a tempered sorbite structure that retains lath characteristics after the hot-work die steel is stretched at 700° C.

5. The hot-work die steel according to claim 1, wherein the hot-work die steel comprises a nanoscale acicular alloy carbide after the hot-work die steel is stretched at 700° C.

6. The hot-work die steel according to claim 5, wherein the nanoscale acicular alloy carbide is: $V_{0.5-0.8}Mo_{0.5-0.6}Cr_{0.15-0.3}W_{0.06-0.14}Nb_{0.01-0.02}C$.

7. The hot-work die steel according to claim 1, wherein the tensile strength of the hot-work die steel at 700° C. is 600-700 MPa.

8. A method for producing the hot-work die steel according to claim 1, comprising the following steps:

a smelting step:

preparing a raw material according to the following mass percentages:

C: 0.20-0.32 wt %, Si: <0.5 wt %, Mn: <0.5 wt %, Cr: 1.5-2.8 wt %, Mo: 1.5-2.5 wt %,

W: 0.5-1.2 wt %, Ni: 0.5-1.6 wt %, V: 0.15-0.7 wt %, Nb: 0.01-0.1 wt %, and a balance of iron, processing the raw material into an electrode rod by arc smelting, secondary refining, vacuum degassing, and forging in a forging furnace;

an electroslag remelting step:

removing an oxidized layer of the electrode rod, then introducing the electrode rod into a vacuum electroslag remelting device for secondary refining, keeping a temperature of water in the water cooling system of the electroslag remelting device not higher than 70° C., and obtaining an electroslag ingot by electroslag remelting from the electrode rod, wherein a melting rate is 7-12 kg/min, and a temperature of a cooling water of a crystallizer is held at 40-50° C.;

a homogenizing annealing step:

heating the electroslag ingot to 1200-1250° C. and holding for 15-23 h;

a forging step:

cooling the electroslag ingot to a forging heating temperature of 1150-1200° C. and then forging to obtain an ingot, wherein an initial forging temperature is 1130 to 1160° C., and a final forging temperature is >850° C.;

an annealing after forging step:

introducing the ingot into an annealing furnace after the temperature of the ingot is lower than 500° C., heating to 830-890° C. at a heating rate not more than 100° C./h, holding for [120 min+r (mm)×2 min/mm] or [120 min+d (mm)/2×2 min/mm], lowering the temperature to below 500° C. at a cooling rate of 20-40° C./h, taking the ingot out from the annealing furnace and air-cooling to obtain an annealed ingot;

a heat treatment of fine grain step:

heating the annealed ingot to 930-1150° C. and performing a first holding for a first holding time of [(15-40) min+r (mm)×2 min/mm] or [(15-40) min+d (mm)/2×2 min/mm], water cooling to 400-500° C. within 1-2 min, then air cooling to 250-280° C. and performing a second holding for a second holding time of 5-10 h; and then holding at a temperature of 660-700° C. for 5-10 h;

a tempering treatment step:

heating the held ingot to 980-1100° C. and holding for [(15-40) min+r (mm)×2 min/mm] or [(15-40) min+d (mm)/2×2 min/mm], then quenching to 50-150° C., and then tempering at 580-660° C. for 6-16 h to obtain the hot-work die steel;

wherein r is a radius of the material and d is a thickness of the material.

9. The method for producing the hot-work die steel according to claim 8, wherein the raw material further comprises at least one of the following constituents: Zr: 0.01-0.03 wt %, Co: 0.10-0.50 wt %, B: 0.001-0.005 wt %, Re: 0.01-0.10 wt %, Ti: 0.02-0.06 wt %, and Y: 0.01-0.1 wt %.

10. The method for producing the hot-work die steel according to claim 8, wherein the forging step includes:

forming and forging by means of a precision forging machine, wherein the forging heating temperature is 900-1050° C., the initial forging temperature is 850-950° C., and the final forging temperature is >800° C.;

alternatively, forming and forging by a hydraulic hammer or oil hydraulic press, wherein the forging heating temperature is 1150-1200° C., the initial forging temperature is 1130-1160° C., and the final forging temperature is >850° C.

11. The method for producing the hot-work die steel according to claim 8, wherein the holding time of the annealing after forging step is 6-8 h.

* * * * *